US012692867B2

(12) United States Patent
Kim et al.

(10) Patent No.: US 12,692,867 B2
(45) Date of Patent: Jul. 28, 2026

(54) COMPRESSOR INCLUDING IMPROVED OIL TRAP AND HOME APPLIANCE INCLUDING THE COMPRESSOR

(71) Applicant: Samsung Electronics Co., Ltd., Suwon-si (KR)

(72) Inventors: Joonhyung Kim, Suwon-si (KR); Munseong Kwon, Suwon-si (KR); Jaewoo Park, Suwon-si (KR); Sedong Lee, Suwon-si (KR); Jongwon Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 18/825,295

(22) Filed: Sep. 5, 2024

(65) Prior Publication Data

US 2025/0198671 A1 Jun. 19, 2025

Related U.S. Application Data

(63) Continuation of application No. PCT/KR2024/013220, filed on Sep. 3, 2024.

(30) Foreign Application Priority Data

Dec. 15, 2023 (KR) ..... 10-2023-0183164

(51) Int. Cl.

| | |
|---|---|
| ***F04C 29/02*** | (2006.01) |
| ***F25B 31/02*** | (2006.01) |
| ***F25B 43/02*** | (2006.01) |

(52) U.S. Cl.

CPC ..... *F04C 29/026* (2013.01); *F25B 31/026* (2013.01); *F25B 43/02* (2013.01); *F04C 2240/809* (2013.01); *F25B 2400/02* (2013.01)

(58) Field of Classification Search

CPC ..... F04C 29/026; F04C 2240/809; F04C 23/008; F25B 31/026; F25B 43/02; F25B 2400/02

See application file for complete search history.

(56) References Cited

U.S. PATENT DOCUMENTS

| | | | |
|---|---|---|---|
| 7,771,180 B2 | 8/2010 | Cho et al. | |
| 10,288,068 B2 * | 5/2019 | Ge | F04C 29/026 |

(Continued)

FOREIGN PATENT DOCUMENTS

| | | |
|---|---|---|
| CN | 106460845 A | 2/2017 |
| CN | 207033751 U | 2/2018 |

(Continued)

OTHER PUBLICATIONS

Chinese Patent and Machine Translation for CN 104500404 A; 1st Inventor: Wu; Title: Compressor; Published: Apr. 8, 2015. (Year: 2015).*

(Continued)

*Primary Examiner* — Mary A Davis
(74) *Attorney, Agent, or Firm* — Jefferson IP Law, LLP

(57) ABSTRACT

A compressor according to an embodiment of the disclosure may include a case storing an oil therein, a compression device disposed inside the case to compress a refrigerant introduced into the case, a driving device disposed inside the case to drive the compression device, and an oil trap portion for separating the refrigerant and the oil or collecting the separated oil when the compression device is operated. The oil trap portion may protrude from an outer surface of the case and be recessed from an inner surface of the case to form a space for accommodating the oil. The oil trap portion may have at least a portion positioned in a cavity area of the case in which the compression device and the driving device are not disposed.

22 Claims, 13 Drawing Sheets

(56) References Cited

U.S. PATENT DOCUMENTS

| | | | | |
|---|---|---|---|---|
| 11,353,027 | B2 | 6/2022 | Kim et al. | |
| 11,609,029 | B2 | 3/2023 | Kawabata | |
| 11,994,126 | B2 * | 5/2024 | Mlsna | F04C 29/025 |
| 2024/0271623 | A1 | 8/2024 | Kawabata et al. | |

FOREIGN PATENT DOCUMENTS

| | | | |
|---|---|---|---|
| CN | 114215756 | A | 3/2022 |
| JP | 2010-174772 | A | 8/2010 |
| JP | 2010-196610 | A | 9/2010 |
| JP | 2011-179456 | A | 9/2011 |
| JP | 2013-227971 | A | 11/2013 |
| JP | 2015-055191 | A | 3/2015 |
| JP | 2015-055192 | A | 3/2015 |
| JP | 2021-071058 | A | 5/2021 |
| JP | 2023-067493 | A | 5/2023 |
| KR | 10-2008-0039661 | A | 5/2008 |
| KR | 10-2008-0078473 | A | 8/2008 |
| KR | 10-2020-0099704 | A | 8/2020 |

OTHER PUBLICATIONS

Chinese Patent and Machine Translation for CN 112460023 A; 1st Inventor: Deng; Title: Compressor and Air Conditioner With the Same; Published: Mar. 9, 2021. (Year: 2021).*

Chinese Patent and Machine Translation for CN 114215756 A; 1st Inventor: Wen; Title: A Rotary Compressor; Published: Mar. 22, 2022. (Year: 2022).*

International Search Report with Written Opinion dated Nov. 19, 2024; International Appln. No. PCT/KR2024/013220.

* cited by examiner

COMPRESSOR INCLUDING IMPROVED OIL TRAP AND HOME APPLIANCE INCLUDING THE COMPRESSOR

CROSS-REFERENCE TO RELATED APPLICATIONS

This application is a continuation application of International Application No. PCT/KR2024/013220 designating the United States, filed on Sep. 3, 2024, in the Korean Intellectual Property Receiving Office, which claims priority from Korean Patent Application No. 10-2023-0183164, filed on Dec. 15, 2023, in the Korean Intellectual Property Office, the disclosures of which are hereby incorporated by reference herein in their entireties.

BACKGROUND

Field

The disclosure relates to a hermetic rotary compressor and a home appliance including the same.

Description of Related Art

A compressor is a mechanical device that increases pressure by compressing air, refrigerant, or various other working gases using a motor or turbine. The compressor may be used in various ways throughout the industry, and when used in the refrigerant cycle, the compressor may convert a refrigerant having a low pressure into a refrigerant having a high pressure and transfer the refrigerant back to the condenser.

Compressors may be largely divided into the reciprocating compressor in which a compression space where working gas is sucked in and discharged is formed between a piston and a cylinder, and the piston compresses the refrigerant while linearly reciprocating within the cylinder, the scroll compressor in which a compression space where working gas is sucked in and discharged between an orbiting scroll and a fixed scroll is formed, and the orbiting scroll rotates along the fixed scroll to compress the refrigerant, and the rotary compressor in which a compression space where working gas is sucked in and discharged is formed between a roller and a cylinder, and the roller rotates eccentrically along an inner wall of the cylinder to compress the refrigerant.

In a rotary compressor among various compressors, oil may be stored in a case for lubricating a compression device for compressing the refrigerant. The stored oil may be separated from the refrigerant by the centrifugal force of the rotor when the compressor is operated and recovered to the lower part of the case. However, when the compressor is operated, a portion of the oil may not be separated from the refrigerant, or a portion of the separated oil may not be recovered but, together with the refrigerant, may be discharged to the outside of the compressor. When the amount of oil discharged to the outside is large, a problem may occur due to poor refueling of the compressor, or heat exchange efficiency of the home appliance including the compressor may be reduced.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a compressor having a structure for collecting or recovering oil separated from a refrigerant when the compressor is operated.

Additional aspects will be set forth in part in the description which follows and, in part, will be apparent from the description, or may be learned by practice of the presented embodiments.

A compressor according to an embodiment of the disclosure may include a case storing an oil therein, a compression device disposed inside the case to compress a refrigerant introduced into the case, a driving device disposed inside the case to drive the compression device, and an oil trap portion for separating the refrigerant and the oil or collecting the separated oil when the compression device is operated. The oil trap portion may protrude from an outer surface of the case and be recessed from an inner surface of the case to form a space for accommodating the oil. The oil trap portion may have at least a portion positioned in a cavity area of the case in which the compression device and the driving device are not disposed.

A home appliance for adjusting a temperature through heat exchange with an outside using a refrigerant may include a compressor for compressing the refrigerant. The compressor may include a case storing an oil therein, a compression device disposed inside the case to compress a refrigerant introduced into the case, a driving device disposed inside the case to drive the compression device, and an oil trap portion for separating the refrigerant and the oil or collecting the separated oil when the compression device is operated. The oil trap portion may protrude from an outer surface of the case and be recessed from an inner surface of the case to form a space for accommodating the oil. The oil trap portion may have at least a portion positioned in a cavity area of the case in which the compression device and the driving device are not disposed.

According to various embodiments of the disclosure, an oil trap portion provided in the cavity area of the case in which the compression device is not disposed may protrude to the outside of the case to form a space for collecting or recovering oil separated from the refrigerant therein, thereby increasing the streamline length of the refrigerant and/or oil in the cavity area, generating and constraining vortex currents in the cavity area, and reducing the flow rate of the refrigerant and/or oil near the discharge pipe of the case. Accordingly, when the compressor is operated, the refrigerant and the oil may be separated smoothly, and the separated oil may be constrained to the cavity area, thereby reducing the amount of oil discharged to the outside of the case.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
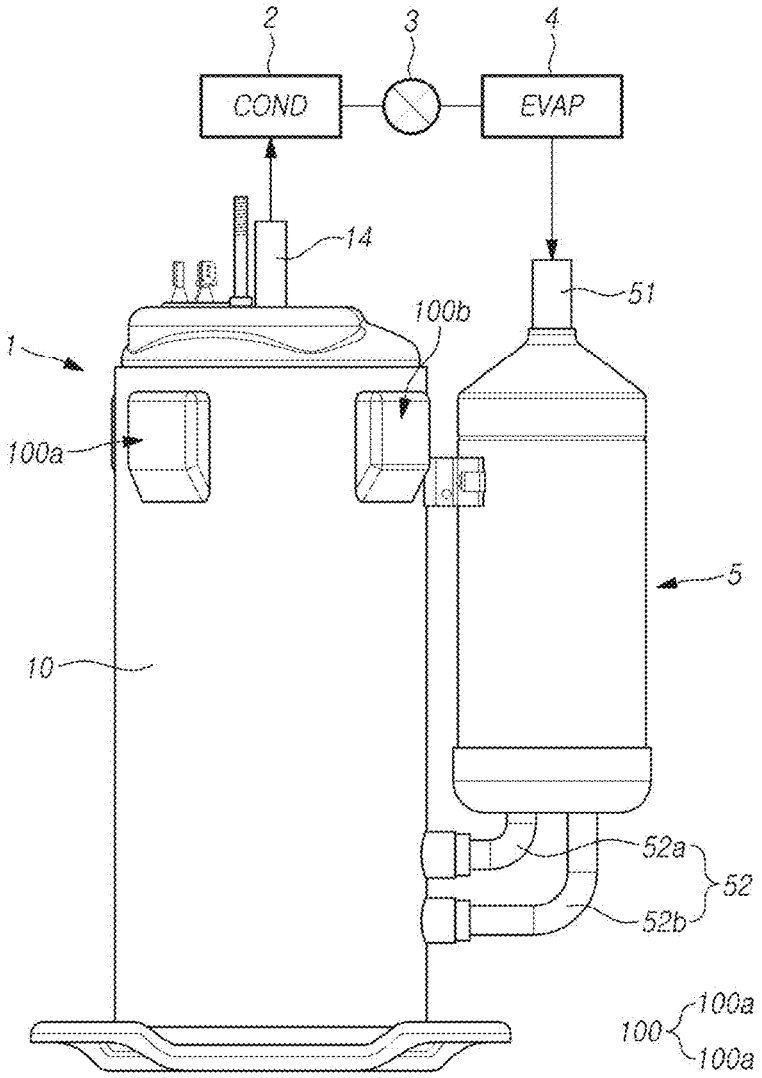
FIG. 1 is a view schematically illustrating a freezing cycle device provided in a home appliance according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases.

As used herein, such terms as "1st" and "2nd," or "first" and "second" may be used to simply distinguish a corresponding component from another, and does not limit the components in other aspect (e.g., importance or order).

It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

It will be further understood that the terms "comprise" and/or "have," as used herein, specify the presence of stated features, integers, steps, operations, elements, and/or components, but do not preclude the presence or addition of one or more other features, integers, steps, operations, elements, components, and/or groups thereof.

It will be understood that when a component is referred to as "connected to," "coupled to", "supported on," or "contacting" another component, the components may be connected to, coupled to, supported on, or contact each other directly or via a third component.

Throughout the specification, when one component is positioned "on" another component, the first component may be positioned directly on the second component, or other component(s) may be positioned between the first and second component.

The term "and/or" may denote a combination(s) of a plurality of related components as listed or any of the components.

Hereinafter, the working principle and various embodiments of the disclosure are described with reference to the accompanying drawings.

FIG. 1 is a view schematically illustrating a freezing cycle device provided in a home appliance according to an embodiment of the disclosure.

Figure 2:
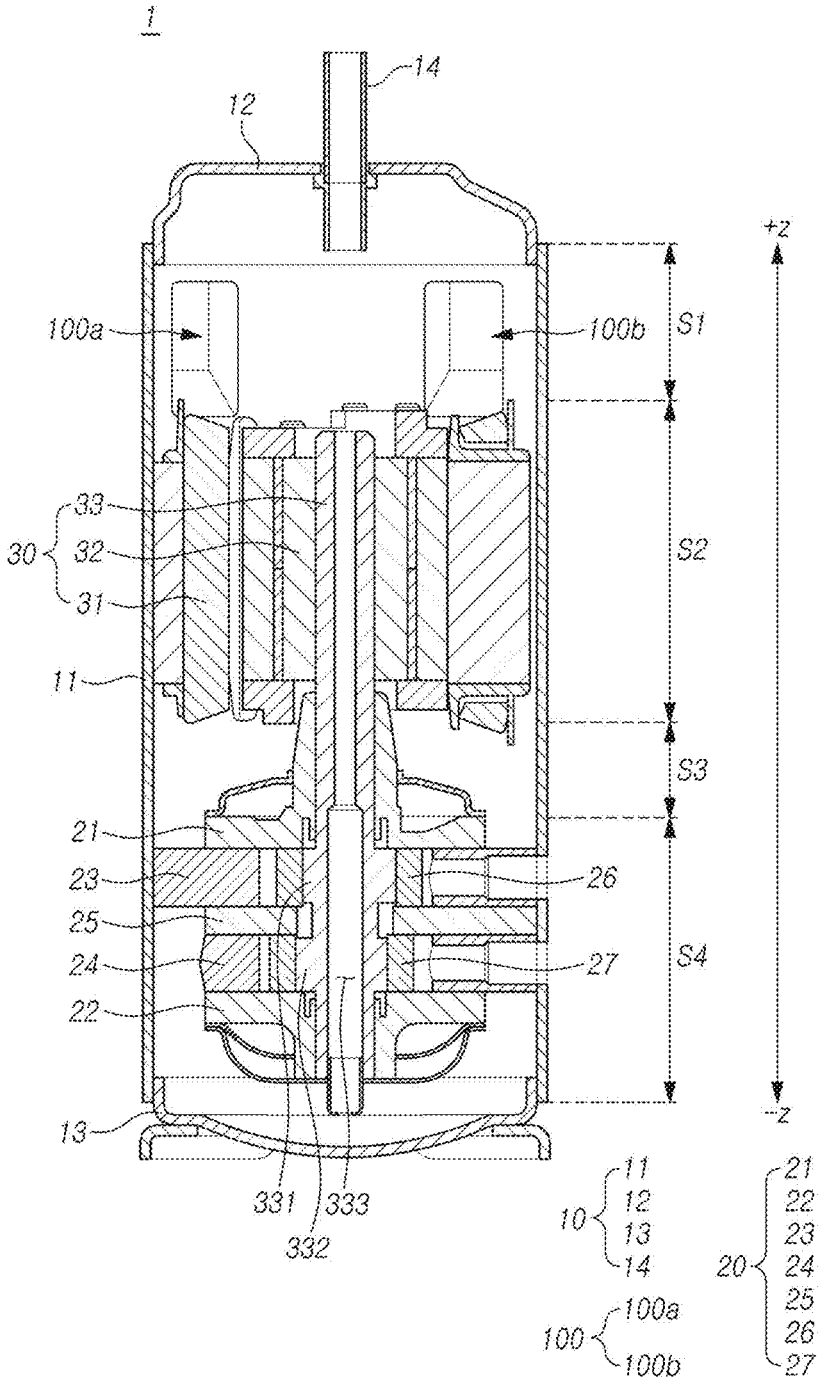
FIG. 2 is a cross-sectional view illustrating a compressor according to an embodiment of the disclosure.

FIG. 2 is a cross-sectional view illustrating a compressor according to an embodiment of the disclosure.

Referring to FIGS. 1 and 2, a freezing cycle device according to an embodiment may perform four cycles of compression, condensation, expansion, and evaporation, and may heat-exchange the refrigerant with the outside (e.g., an indoor space). The freezing cycle device may include a compressor 1, a condenser 2, an expansion valve 3, and an evaporator 4. The four cycles of compression, condensation, expansion, and evaporation are performed by the devices, respectively, while the refrigerant circulates through the compressor 1, the condenser 2, the expansion valve 3, and the evaporator 4.

According to an embodiment, the compressor 1 may compress the refrigerant into a gaseous state of high temperature and high pressure (compression cycle). The high-temperature and high-pressure refrigerant gas compressed by the compressor 1 flows into the condenser 2.

According to an embodiment, the condenser 2 may heat-exchange the refrigerant compressed by the compressor 1 with the outside, and may condense the refrigerant into a liquid state (condensation cycle). The condenser 2 may radiate heat to the surroundings through the condensation process of the refrigerant. The refrigerant condensed in the condenser 2 flows into the expansion valve 3.

According to an embodiment, the expansion valve 3 may expand the refrigerant in the high-temperature and high-pressure state condensed in the condenser 2 into a low-temperature and low-pressure state (expansion cycle). The low-temperature and low-pressure refrigerant expanded in the expansion valve 3 flows into the evaporator 4.

According to an embodiment, the evaporator 4 may heat-exchange the refrigerant expanded in the expansion valve 3 with the outside to evaporate the refrigerant into a gaseous state (evaporation cycle). The evaporator 4 may absorb ambient heat through the evaporation process of the refrigerant. The low-temperature and low-pressure refrigerant gas evaporated in the evaporator 4 is returned to the compressor 1.

The temperature of the outside (e.g., the indoor space) may be adjusted through the above-described freezing cycle in each device. The freezing cycle device may be provided in a home appliance. The home appliance may include an air conditioner, a refrigerator, or a freezer. However, the disclosure is not limited thereto, and the freezing cycle device may be used in various home appliances having a freezing cycle.

According to an embodiment, the freezing cycle device may further include an accumulator 5 for separating the gaseous refrigerant from the liquid refrigerant. In an embodiment, the accumulator 5 may phase-separate the refrigerant introduced from the evaporator 4 into the refrigerant in the vapor state and the refrigerant in the liquid state, and then supply only the refrigerant in the vapor state to the compressor 1. In this case, liquid compression in the compressor 1 may be prevented. The accumulator 5 may be referred to as a liquid separator 5. In an embodiment, the accumulator 5 may be connected to the evaporator 4 through a first connection pipe 51 and may be connected to the compressor 1 through a second connection pipe 52. In an embodiment, the second connection pipes 52*a* and 52*b* may correspond in number to cylinders 23 and 24 of the compression device 20 to be described below, and may be connected to the corresponding cylinders 23 and 24, respectively, to supply the refrigerant.

According to an embodiment, the compressor 1 may include a case 10 forming an exterior, a compression device 20 for compressing the refrigerant, and a driving device 30 for providing a driving force to the compression device 20.

According to an embodiment, the case 10 may form the exterior of the compressor 1. In an embodiment, components constituting the compressor 1, such as the compression device 20 and the driving device 30, may be disposed inside the case 10, and the devices may be sealed from the outside by the case 10. In an embodiment, oil for lubricating the compression device 20 may be stored in a lower portion of the case 10.

According to an embodiment, the case 10 may be divided into several areas (or sections) along the upper/lower direction (e.g., the ±z-axis direction) based on whether a device (e.g., the compression device 20 or the driving device 30) is disposed in one area of the inner space of the case 10. For example, the case 10 may include a first area S1 positioned at an uppermost side and being empty, a second area S2 positioned under the first area S1 and having the driving device 30 disposed therein, a third area S3 positioned between the second area S2 and a fourth area S4 to be described below and being empty, and a fourth area S4 positioned at a lowermost side and having the compression device 20 disposed therein. Here, the first area S1 and the third area S3 may be referred to as cavity areas, and in this case, the first area S1 may be referred to as an upper cavity area, and the third area S3 may be referred to as a lower cavity area. Further, oil for lubricating the compression device 20 may be stored in the fourth area S4.

According to an embodiment, the case 10 may include a main body 11, a cover 12, a base 13, and a discharge pipe 14.

According to an embodiment, the main body 11 may have a hollow cylindrical shape, but the disclosure is not limited thereto. In an embodiment, the upper side and/or the lower side of the main body 11 may be open. In a side surface of the main body 11, a refrigerant inlet (not shown) through which the refrigerant is introduced from the outside (e.g., the accumulator 5 and/or the evaporator 4) may be formed, although not specifically illustrated in these drawings.

According to an embodiment, an oil trap portion 100 may be provided on the outer circumferential surface of the main body 11 to separate the refrigerant from the oil or to collect the separated oil when the compressor 1 is operated. A plurality of oil trap portions 100*a* and 100*b* may be provided according to the design, and the structure, shape, and/or function of the oil trap portion 100 is described below.

According to an embodiment, the cover 12 may be disposed above the main body 11. For example, the cover 12 may be disposed to cover the upper side of the open main body 11. In an embodiment, the cover 12 may be coupled to the main body 11 by a coupling method such as welding.

According to an embodiment, the base 13 may be disposed below the main body 11. For example, the base 13 may be disposed to cover the open lower side of the main body 11. In an embodiment, the base 13 may be coupled to the main body 11 by a coupling method such as welding.

According to an embodiment, the discharge pipe 14 may connect the compressor 1 and the condenser 2, as illustrated in FIG. 1. In an embodiment, the discharge pipe 14 may guide the refrigerant compressed at high temperature and high pressure to the condenser 2 by the operation of the compressor 1. In an embodiment, the discharge pipe 14 may pass through the cover 12 of the case 10 and extend to the inside of the case 10.

According to an embodiment, the compression device 20 may be disposed in a lower portion of the case 10. In an embodiment, the compression device 20 may be positioned below the driving device 30 and may be connected to the driving device 30 through a shaft 33.

According to an embodiment, the compression device 20 may include a first flange 21, a second flange 22, a first cylinder 23, a second cylinder 24, an intermediate plate 25, a first roller 26, and a second roller 27.

According to an embodiment, the first flange 21 may be disposed above the first cylinder 23. In an embodiment, the first flange 21 may be press-fitted to the inner circumferential surface of the case 10. In an embodiment, the first flange 21 may be coupled to the shaft 33 to surround at least a portion of the shaft 33, and may support a rotational motion of the shaft 33. The first flange 21 may be referred to as a first bearing 21.

According to an embodiment, the second flange 22 may be disposed below the second cylinder 24. In an embodiment, the second flange 22 may be disposed to overlap the first flange 21. In an embodiment, the second flange 22 may be press-fitted to the inner circumferential surface of the case 10. In an embodiment, the second flange 22 may be coupled to the shaft 33 to surround at least a portion of the shaft 33, and may support a rotational motion of the shaft 33. The second flange 22 may be referred to as a second bearing 22.

According to an embodiment, the first cylinder 23 may have a hollow cylindrical shape. In an embodiment, the first cylinder 23 may form an inner space (not shown) in which the refrigerant is sucked/compressed, together with the first flange 21 and the intermediate plate 25. The inner space (not shown) of the first cylinder 23 may be divided into a suction chamber (not shown) into which the refrigerant is sucked by the first roller 26 and a first vane (not shown) elastically contacting the first roller 26, and a compression chamber (not shown) in which the refrigerant is compressed.

According to an embodiment, the second cylinder 24 may have a hollow cylindrical shape. In an embodiment, the second cylinder 24, together with the second flange 22 and the intermediate plate 25, may form an inner space (not shown) in which the refrigerant is sucked/compressed. The inner space (not shown) of the second cylinder 24 may be divided into a suction chamber (not shown) into which the refrigerant is sucked by the second roller 27 and a second vane (not shown) elastically contacting the second roller 27, and a compression chamber (not shown) in which the refrigerant is compressed.

According to an embodiment, the intermediate plate 25 may be disposed between the first cylinder 23 and the second cylinder 24. In an embodiment, the intermediate plate 25 may partition the respective inner spaces of the first cylinder 23 and the second cylinder 24.

According to an embodiment, the first roller 26 may have a hollow cylindrical shape. In an embodiment, the first roller 26 may be designed to have a diameter smaller than that of the first cylinder 23. In an embodiment, the first roller 26 may be disposed inside the first cylinder 23 and may be disposed to surround the shaft 33 penetrating the first cylinder 23. In this case, when the shaft 33 rotates, the first roller 26 may rotate along the inner circumferential surface of the first cylinder 23 in the inner space (not shown) of the first cylinder 23 to compress the refrigerant.

According to an embodiment, the second roller 27 may have a hollow cylindrical shape. In an embodiment, the second roller 27 may be designed to have a diameter smaller than that of the second cylinder 24. In an embodiment, the second roller 27 may be disposed inside the second cylinder 24 and may be disposed to surround the shaft 33 penetrating the second cylinder 24. In this case, when the shaft 33 rotates, the second roller 27 may rotate along the inner circumferential surface of the second cylinder 24 in the inner space (not shown) of the second cylinder 24 to compress the refrigerant.

In describing the compression device 20 with reference to the drawings, the compression device 20 has been described as a two-cylinder type compression device provided with two cylinders 23 and 24, but the disclosure is not limited thereto, and even when one cylinder is provided or a plurality of (e.g., three or more) cylinders are provided, the description of the disclosure made below may be applied in substantially the same or similar manner.

According to an embodiment, the driving device 30 may include a stator 31 fixed to an inner surface of the case 10, a rotor 32 rotatably disposed inside the stator 31, and a shaft 33 passing through the rotor 32 and rotatable together with the rotor 32.

According to an embodiment, the driving device 30 may rotate the rotor 32 using the electromagnetic interaction between the stator 31 and the rotor 32, and may operate the compression device 20 by transferring the rotational force of the rotor 32 to the compression device 20 through the shaft 33.

According to an embodiment, the shaft 33 may pass through the flanges 21 and 22, the cylinders 23 and 24, and the intermediate plate 25 of the compression device 20. According to an embodiment, the shaft 33 may include eccentric portions 331 and 332 that contact the first roller 26 and the second roller 27, respectively, and have axes off the central axis of the shaft 33. When the shaft 33 rotates, the rollers 26 and 27 are eccentrically rotated or orbited by the eccentric portions 331 and 332, respectively. According to an embodiment, the shaft 33 may include an oil hole 333 that passes through the central axis of the shaft 33 and extends in the upper/lower direction. When the shaft 33 rotates, the oil stored in the case 10 rises along the oil hole 333 and is supplied to the inside of the compression device 20 through an oil flow path (not shown) provided in the shaft 33.

Figure 3:
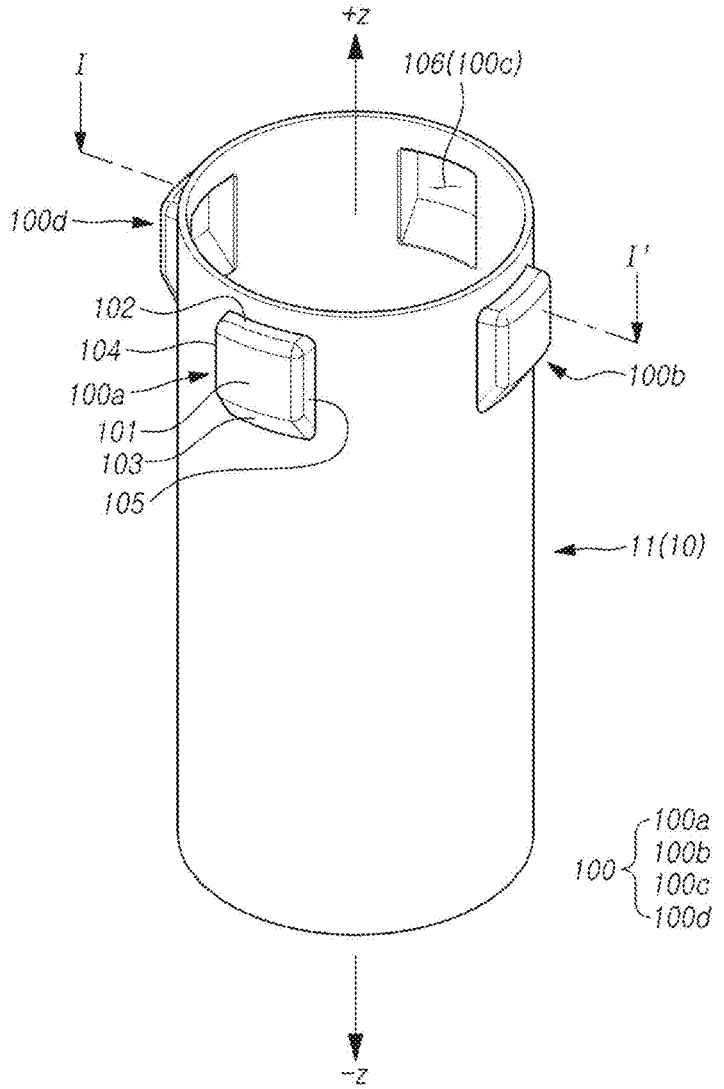
FIG. 3 is a perspective view illustrating a main body of a case according to an embodiment of the disclosure.

FIG. 3 is a perspective view illustrating a main body of a case according to an embodiment of the disclosure.

Figure 4:
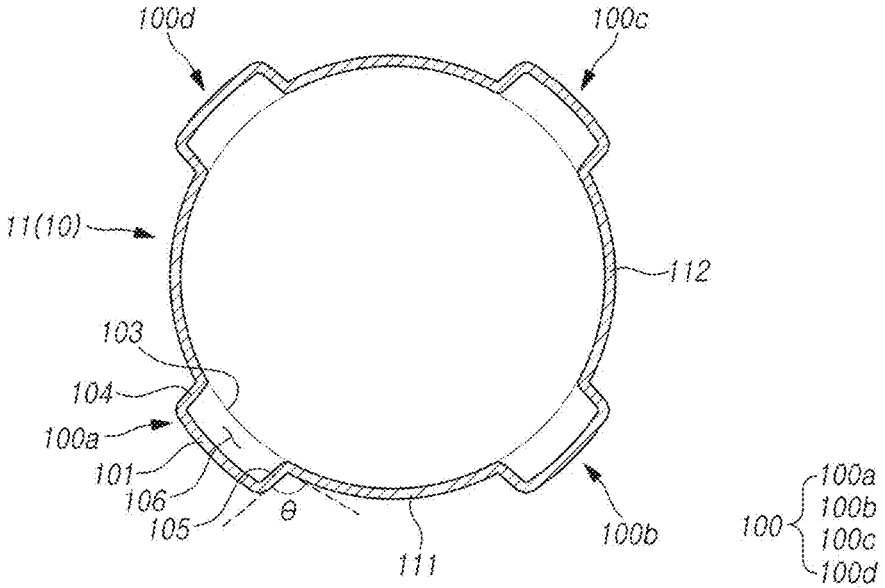
FIG. 4 is a cross-sectional view taken along line I-I' of FIG. 3 according to an embodiment of the disclosure.

FIG. 4 is a cross-sectional view taken along line I-I' of FIG. 3 according to an embodiment of the disclosure.

According to an embodiment, a case 10 may include an oil trap portion 100 for separating the refrigerant and the oil or collecting the separated oil when the compressor (e.g., the compressor 1 of FIG. 1) is operated.

The configuration of the oil trap portion 100 of FIGS. 3 and 4 may be identical in whole or part to the configuration of the oil trap portion 100 of FIGS. 1 and 2. The embodiments of FIGS. 3 and 4 may be selectively combined with the embodiments of FIGS. 1 and 2 and the embodiments of FIGS. 5 to 13.

According to an embodiment, the oil trap portion 100 may be convex to the outside of the case 10 and may be configured to have a hollow embossed (or embossing) structure. In an embodiment, an outer surface of the oil trap portion 100 may protrude from the outer surface of the main body 11 of the case 10. In an embodiment, an inner surface of the oil trap portion 100 may be recessed from the inner surface 112 of the main body 11 of the case 10. The outer surface and the inner surface of the oil trap portion 100 may form a step with the outer surface 111 and the inner surface 112 of the main body 11. A space 106 in which oil is accommodated may be formed inside the oil trap portion 100 when the compressor 1 is operated.

According to an embodiment, the oil trap portion 100 may be disposed in at least one of a plurality of areas (e.g., S1, S2, S3, and S4 of FIG. 2). For example, the oil trap portion 100 may be disposed in the upper cavity area S1 in which the refrigerant and/or the oil flow is formed when the compressor 1 is operated among the plurality of areas S1, S2, S3, and S4.

According to an embodiment, a plurality of oil trap portions 100 may be provided. In an embodiment, the plurality of oil trap portions 100*a*, 100*b*, 100*c*, and 100*d* may be spaced apart from each other along the circumference of the main body 11 of the case 10.

According to an embodiment, the oil trap portion 100 may include a plurality of walls 101, 102, 103, 104, and 105 surrounding and defining the space 106 in which oil is accommodated. According to an embodiment, the plurality of walls 101, 102, 103, 104, and 105 may include a front wall 101 forming a front surface of the oil trap portion 100, an upper wall 102 forming an upper surface of the oil trap portion 100, a lower wall 103 forming a lower surface of the oil trap portion 100, and side walls 104 and 105 forming side surfaces of the oil trap portion 100.

According to an embodiment, the front wall 101 of the oil trap portion 100 may have a rectangular shape, but the disclosure is not limited thereto, and the front wall 101 of the oil trap portion 100 may have a circular shape or a polygonal shape including a rectangular shape.

According to an embodiment, the upper wall 102 of the oil trap portion 100 may have a horizontal plane for preventing oil contained in the space 106 of the oil trap portion 100 from flowing to a discharge pipe (e.g., the discharge pipe 14 of FIG. 1). For example, the upper wall 102 of the oil trap portion 100 may be disposed to be substantially perpendicular to the outer surface 111 and/or the inner surface 112 of the main body 11 of the case 10.

According to an embodiment, the lower wall 103 of the oil trap portion 100 may have an inclined surface for guiding the oil accommodated in the space 106 of the oil trap portion 100 to the lower portion of the case 10. For example, the lower wall 103 of the oil trap portion 100 may be disposed to be inclined with respect to the outer surface 111 and/or the inner surface 112 of the main body 11 of the case 10.

According to an embodiment, the side walls 104 and 105 of the oil trap portion 100 may be disposed to have a predetermined angle θ with respect to the outer surface 111 and/or the inner surface 112 of the main body 11 of the case 10. For example, the side walls 104 and 105 of the oil trap portion 100 may be disposed so that an angle formed with the outer surface 111 and/or the inner surface 112 of the main body 11 of the case 10 is within a range of 90 degrees to 120 degrees. When the compressor 1 is operated, it is possible to restrict or reduce the oil accommodated in the space 106 of the oil trap portion 100 from escaping off the space 106 by the flow of the oil and/or the refrigerant.

In general, when the compressor 1 is operated, e.g., when the driving device 30 is operated (or rotated), oil having a density larger than that of the refrigerant may be adsorbed to the inner surface 112 of the case 10 by centrifugal force. The adsorbed oil may flow downward along the inner surface 112 of the case 10 and is recovered to the lower portion of the case 10. However, when a predetermined time elapses after the operation of the compressor 1, the oil separated from the refrigerant may no longer be adsorbed to the inner surface 112 of the case 10 by the oil adsorbed to the inner surface 112 of the case 10 and may be discharged to the outside of the compressor 1 together with the refrigerant.

According to an embodiment of the disclosure, when the oil trap portion 100 is provided in the case 10, the area and/or volume of the oil collected by the case 10 may be additionally secured by providing the space 106 in which the oil is accommodated in the case 10 through the structure of the oil trap portion 100. Accordingly, when the compressor 1 is operated, the amount (or the amount of discharged oil) of oil that may not be recovered but is discharged together with the refrigerant may be reduced.

Figure 5:
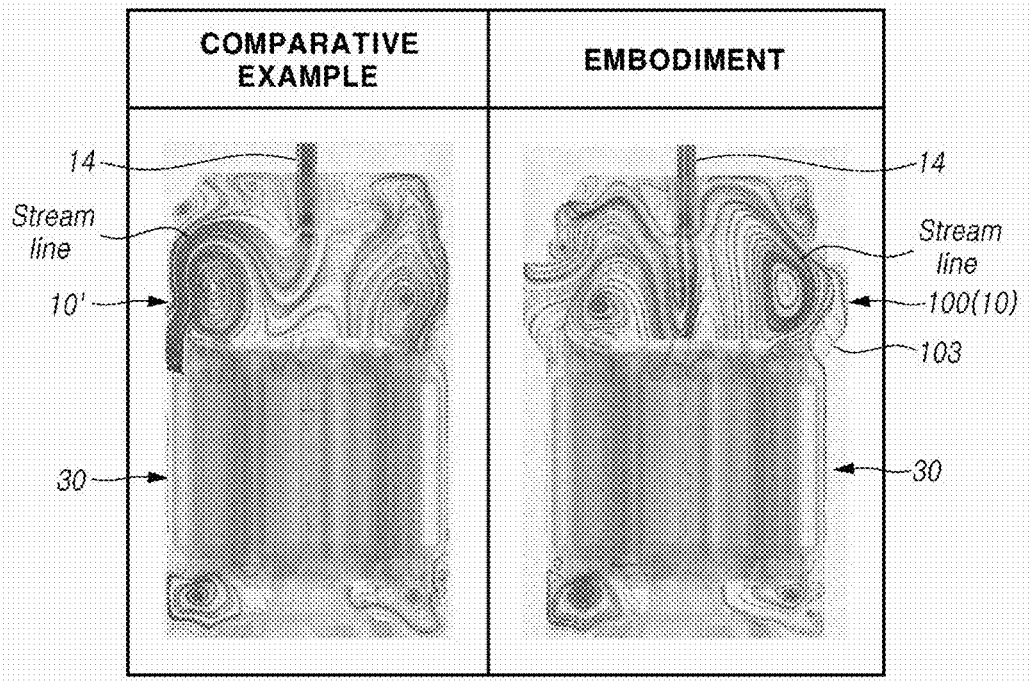
FIG. 5 is a view comparing a fluid flow in a compressor according to an embodiment of the disclosure with a fluid flow in a compressor according to a comparative example.

FIG. 5 is a view comparing a fluid flow in a compressor according to an embodiment of the disclosure with a fluid flow in a compressor according to a comparative example.

Figure 6:
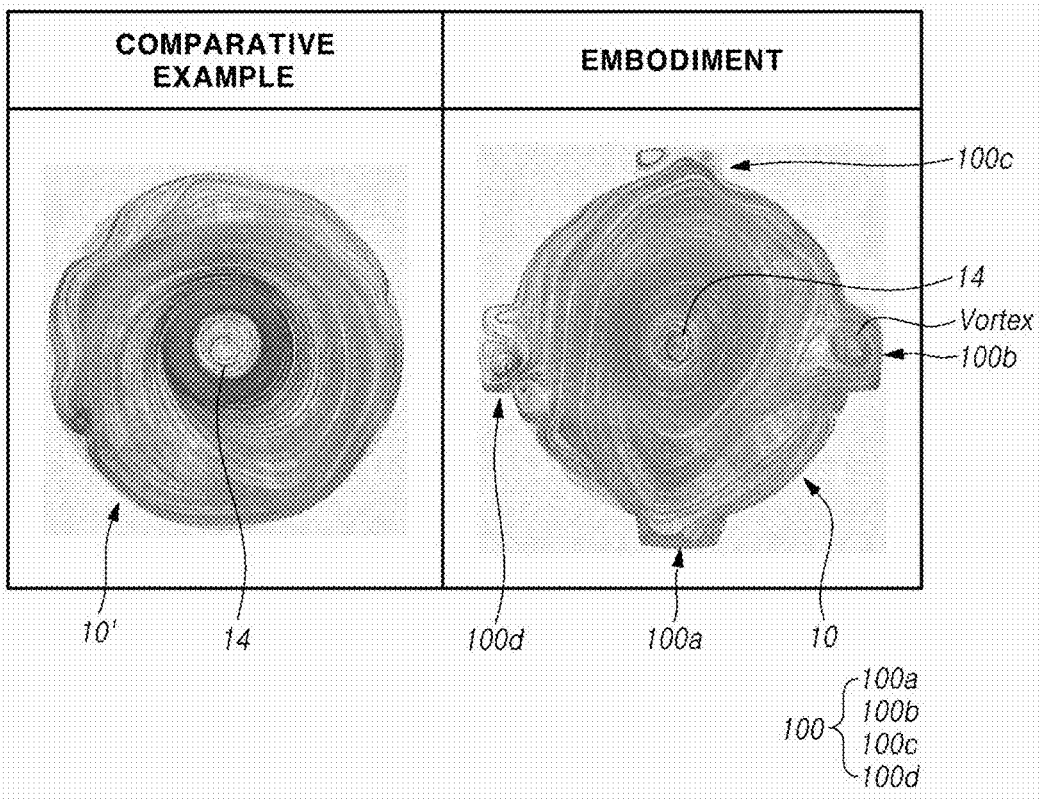
FIG. 6 is a view comparing a fluid flow in a compressor according to an embodiment of the disclosure with a fluid flow in a compressor according to a comparative example.

FIG. 6 is a view comparing a fluid flow in a compressor according to an embodiment of the disclosure with a fluid flow in a compressor according to a comparative example.

Figure 7:
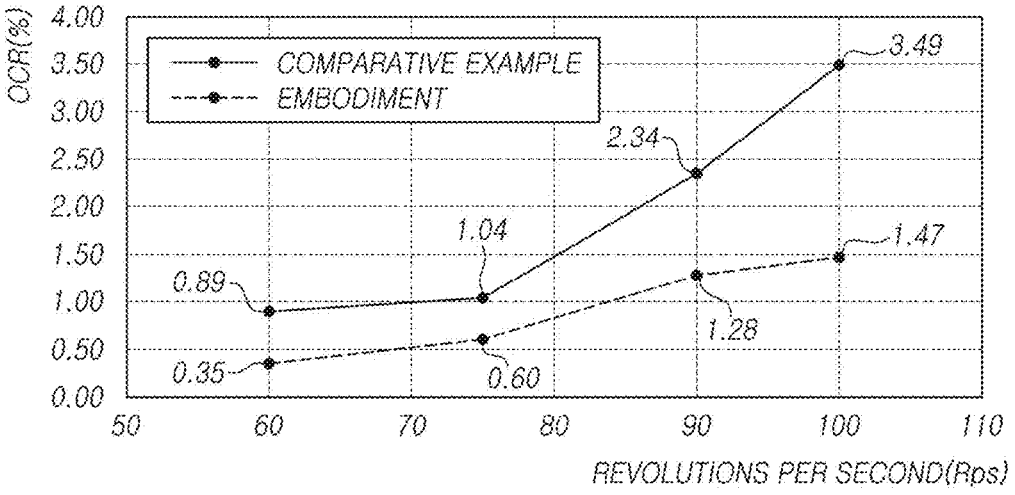
FIG. 7 is a graph comparing an amount of discharged oil of a compressor according to an embodiment of the disclosure with an amount of discharged oil of a compressor according to a comparative example.

FIG. 7 is a graph comparing an amount of discharged oil of a compressor according to an embodiment of the disclosure with an amount of discharged oil of a compressor according to a comparative example.

According to an embodiment, a case 10 may include an oil trap portion 100 for separating the refrigerant and the oil or collecting the separated oil when the compressor (e.g., the compressor 1 of FIG. 1) is operated.

The configuration of the oil trap portion 100 of FIGS. 5 to 7 may be identical in whole or part to the configuration of the oil trap portion 100 of FIGS. 1 to 4. The embodiments of FIGS. 5 to 7 may be selectively combined with the embodiments of FIGS. 1 to 4 and the embodiments of FIGS. 8 to 13.

FIG. 5 illustrates the flow of fluid (e.g., refrigerant and/or oil) in each of the comparative example and the embodiment in cross sections of the cases 10' and 10, taken vertically.

Referring to FIG. 5, from the flow of the fluid inside the case 10' of the comparative example in which the oil trap portion 100 is not provided and the flow of the fluid inside the case 10 of the embodiment in which the oil trap portion 100 is provided, it may be identified that in the case of the embodiment, the length of the stream line of the fluid is longer than that of the comparative example due to the area and/or volume additionally secured by the oil trap portion 100. In this case, when the compressor 1 is operated, the separation time between the refrigerant and the oil may be increased due to the increased streamline length, so that the separation between the refrigerant and the oil may be smooth.

Further, in an embodiment, when the compressor 1 is operated, a flow of the fluid downward in the space (e.g., the space 106 of FIG. 3) of the oil trap portion 100 may be formed by the inclined structure of the lower wall 103 of the oil trap portion 100, thereby facilitating oil recovery to the lower portion of the case 10.

FIG. 6 illustrates the flow of fluid in each of the comparative example and an embodiment in the directions of the cross sections of the cases 10*a* and 10, taken horizontally.

Referring to FIG. 6, from the flow of the fluid inside the case 10' of the comparative example in which the oil trap portion 100 is not provided and the flow of the fluid inside the case 10 of the embodiment in which the oil trap portion 100 is provided, it may be identified that in the case of the embodiment, the velocity of flow near the discharge pipe 14 is reduced compared to the comparative example due to the area and/or volume additionally secured by the oil trap portion 100. In this case, the amount of fluid directly injected into the discharge pipe 14 when the compressor 1 is operated may be reduced due to the reduced the velocity of flow.

Further, in an embodiment, a vortex may be formed in the space 106 of the oil trap portion 100, so that the oil and the refrigerant accommodated in the space 106 may be separated smoothly, and the fluid accommodated in the space 106 may be prevented from flowing outside the space 106.

In general, as described above, when a predetermined time elapses after the operation of the compressor 1, the amount (or the amount of discharged oil) of oil discharged to the outside of the compressor 1 together with the refrigerant increases.

Referring to FIG. 7, when comparing the oil circulation ratio (OCR) of the comparative example in which the oil trap portion 100 is not provided and the oil circulation ratio of the embodiments in which the oil trap portion 100 is provided, it may be identified that the oil circulation ratio increases as the RPM of the driving device 30 increases in both the comparative example and the embodiment. However, in an embodiment, when the compressor 1 is operated, the amount of oil separated from the refrigerant increases as the number of revolutions of the driving device 30 increases by the oil trap portion 100, but the separated oil stagnates inside the oil trap portion 100, so that the oil circulation rate is lower than that of the comparative example.

Figure 8:
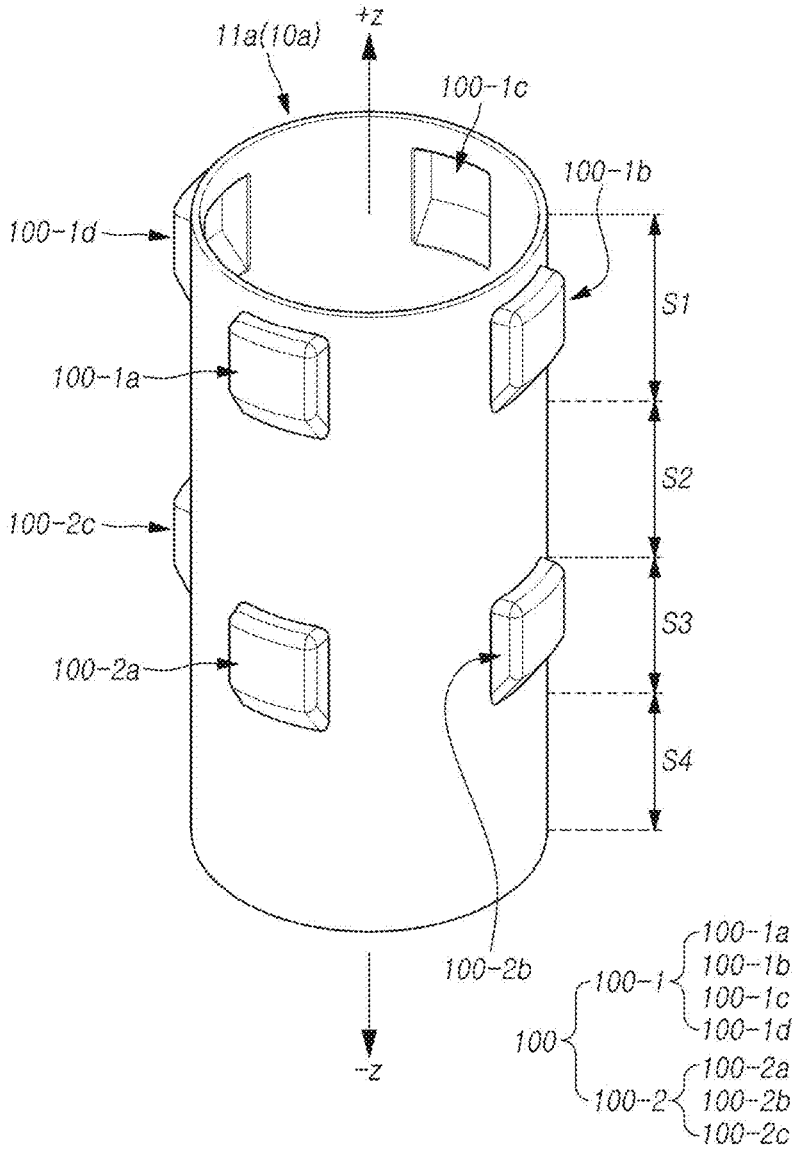
FIG. 8 is a perspective view illustrating a main body of a case according to an embodiment of the disclosure.

FIG. 8 is a perspective view illustrating a main body of a case according to an embodiment of the disclosure.

According to an embodiment, a case 10*a* may include an oil trap portion 100 for separating the refrigerant and the oil or collecting the separated oil when the compressor (e.g., the compressor 1 of FIG. 1) is operated.

The configuration of the oil trap portion 100 of FIG. 8 may be identical in whole or part to the configuration of the oil trap portion 100 of FIGS. 1 to 7. The embodiment of FIG. 8 may be selectively combined with the embodiments of FIGS. 1 to 7 and the embodiments of FIGS. 9 to 13.

Referring to FIG. 8, a plurality of oil trap portions 100 may be provided in the main body 11*a* of the case 10*a* according to an embodiment.

According to an embodiment, the plurality of oil trap portions 100 may be disposed in group in each of at least two of the plurality of areas S1, S2, S3, and S4 of the case 10*a*. In an embodiment, the plurality of oil trap portions 100 may be divided into a first oil trap portion group 100-1 disposed in the first area S1 and a second oil trap portion group 100-2 disposed in the third area S3. In an embodiment, the first oil trap portion group 100-1 and the second oil trap portion group 100-2 may be disposed to be spaced apart from each other in the upper/lower direction (e.g., the ±z-axis direction) of the main body 11*a*. In an embodiment, the plurality of oil trap portions 100-1*a*, 100-1*b*, 100-1*c*, and 100-1*d* belonging to the first oil trap portion group 100-1 may be disposed in the first area S1 to be spaced apart from each other along the circumferential direction of the main body 11*a*. In an embodiment, the plurality of oil trap portions 100-2*a*, 100-2*b*, and 100-2*c* belonging to the second oil trap portion group 100-2 may be disposed in the third area S3 to be spaced apart from each other along the circumferential direction of the main body 11*a*. However, the disclosure is not limited thereto, and the plurality of oil trap portion groups may be spaced apart from each other in the upper/lower direction within a range over an upper surface, stored in a lower portion of the case 10*a*.

Figure 9:
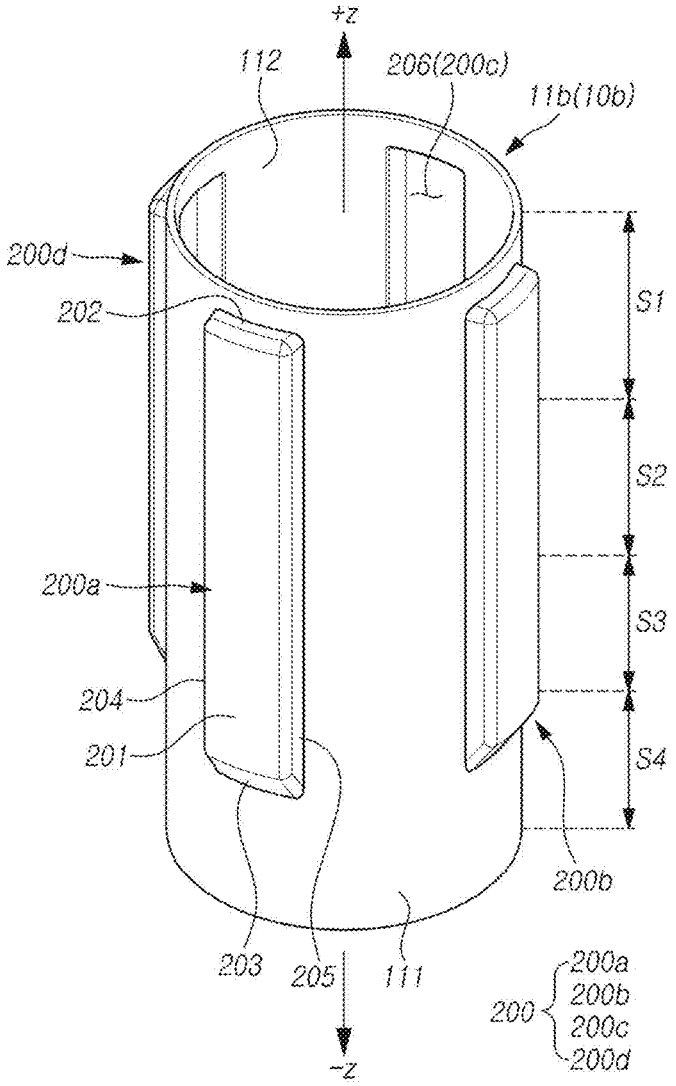
FIG. 9 is a perspective view illustrating a main body of a case according to an embodiment of the disclosure.

FIG. 9 is a perspective view illustrating a main body of a case according to an embodiment of the disclosure.

Referring to FIG. 9, a main body 11*b* of a case 10*b* according to an embodiment may be provided with an oil trap portion 200 for separating the refrigerant from the oil or collecting the separated oil when the compressor (e.g., the compressor 1 of FIG. 1) is operated.

The configuration of the oil trap portion 200 of FIG. 9 may be identical in whole or part to the configuration of the oil trap portion 100 of FIGS. 1 to 8. The embodiment of FIG. 9 may be selectively combined with the embodiments of FIGS. 1 to 8 and the embodiments of FIGS. 10 to 13.

According to an embodiment, the oil trap portion 200 may be convex to the outside of the case 10*b* and may be configured to have a hollow embossed (or embossing) structure. In an embodiment, the outer surface of the oil trap portion 200 may protrude from the outer surface 111 of the main body 11*b*. In an embodiment, the inner surface of the oil trap portion 200 may be recessed from the inner surface 112 of the main body 11*b*. The outer surface and the inner surface of the oil trap portion 200 may form a step with the outer surface 111 and the inner surface 112 of the main body 11*b*. In this case, a space 206 in which oil is accommodated may be formed inside the oil trap portion 200 when the compressor 1 is operated.

According to an embodiment, the oil trap portion 200 may be disposed to span at least one of the plurality of areas S1, S2, S3, and S4. For example, as illustrated in FIG. 9, the oil trap portion 200 may be disposed to span all of the plurality of areas S1, S2, S3, and S4. For example, the oil trap portion 200 may extend in the upper/lower direction (e.g., the ±z-axis direction) of the main body 11*b* within a plurality of areas S1, S2, S3, and S4. In this case, the extended length of the oil trap portion 200 may be limited to the upper surface of the oil stored in the lower portion of the case 10*b*.

According to an embodiment, a plurality of oil trap portions 200 may be provided. In an embodiment, the plurality of oil trap portions 200*a*, 200*b*, 200*c*, and 200*d* may be disposed to be spaced apart from each other along the circumference of the main body 11*b* of the case 10*b*.

According to an embodiment, the oil trap portion 200 may surround the space 206 in which oil is accommodated, and may include a plurality of walls 201, 202, 203, 204, and 205 defining the space 206. According to an embodiment, the plurality of walls 201, 202, 203, 204, and 205 may include a front wall 201 forming a front surface of the oil trap portion 200, an upper wall 202 forming an upper surface of the oil trap portion 200, a lower wall 203 forming a lower surface of the oil trap portion 200, and side walls 204 and 205 forming side surfaces of the oil trap portion 200.

According to an embodiment, the front wall 201 of the oil trap portion 200 may have a rectangular shape, but the disclosure is not limited thereto, and the front wall 201 of the oil trap portion 200 may have a circular shape or a polygonal shape including a rectangular shape.

According to an embodiment, the upper wall 202 of the oil trap portion 200 may have a horizontal plane for preventing oil contained in the space 206 of the oil trap portion 200 from flowing to a discharge pipe (e.g., the discharge pipe 14 of FIG. 1). For example, the upper wall 202 of the oil trap portion 200 may be disposed perpendicular to the outer surface 111 and/or the inner surface 112 of the main body 11*b* of the case 10*b*.

According to an embodiment, the lower wall 203 of the oil trap portion 200 may have an inclined surface for guiding the oil accommodated in the space 206 of the oil trap portion 200 to the lower portion of the case 10*b*. For example, the lower wall 203 of the oil trap portion 200 may be disposed to be inclined with respect to the outer surface 111 and/or the inner surface 112 of the main body 11*b* of the case 10*b*.

According to an embodiment, the side walls 204 and 205 of the oil trap portion 200 may be disposed to have a predetermined angle with respect to the outer surface 111 and/or the inner surface 112 of the main body 11 of the case 10. For example, the side walls 104 and 105 of the oil trap portion 100 may be disposed so that an angle formed with the outer surface 111 and/or the inner surface 112 of the main body 11*b* of the case 10*b* is within a range of 90 degrees to 120 degrees.

Figure 10:
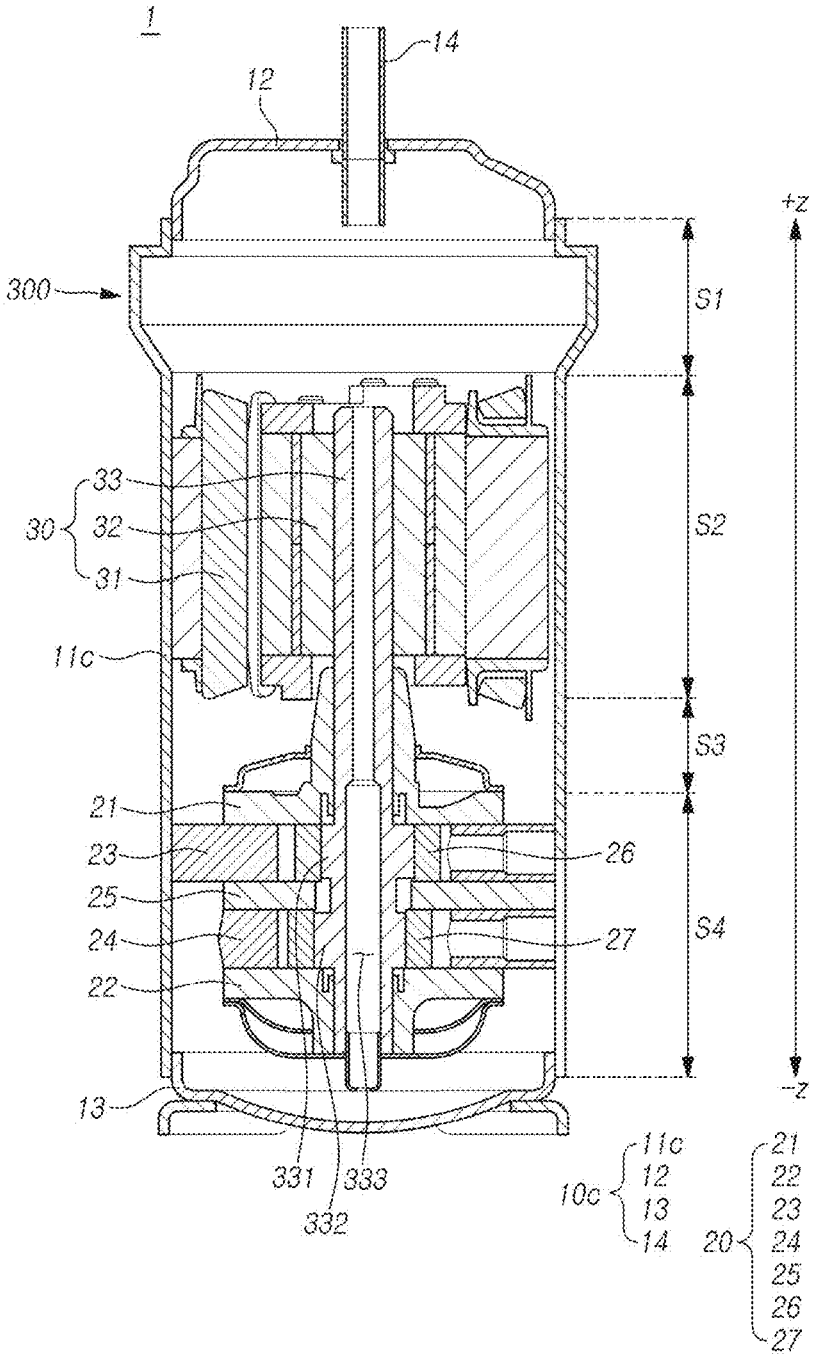
FIG. 10 is a cross-sectional view illustrating a compressor according to an embodiment of the disclosure.

FIG. 10 is a cross-sectional view illustrating a compressor according to an embodiment of the disclosure.

Figure 11:
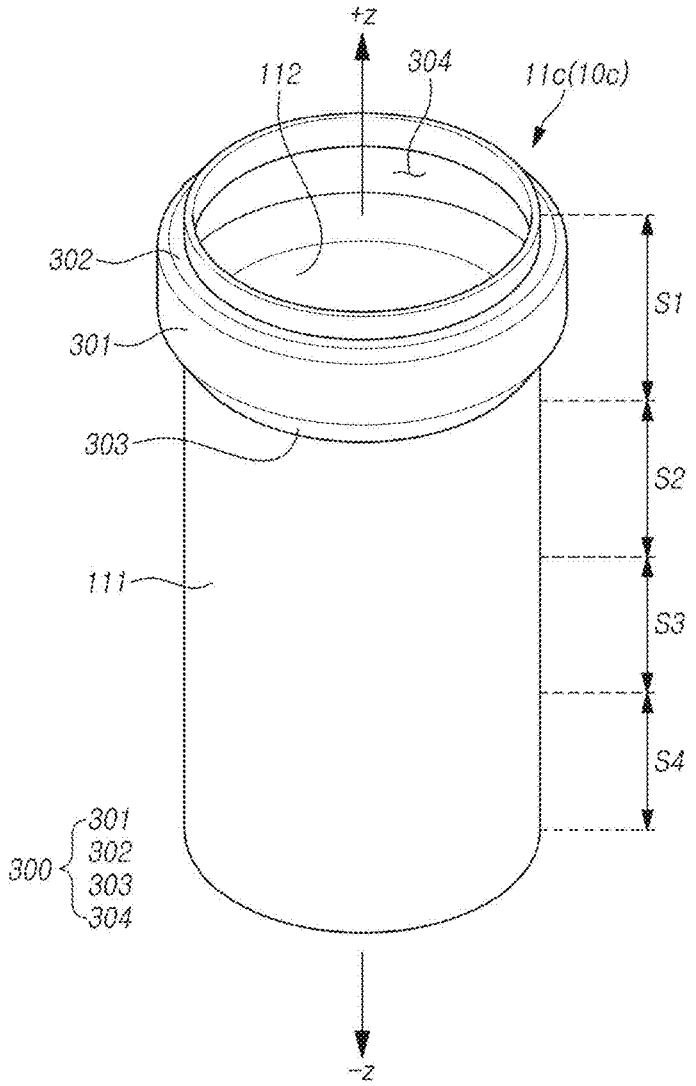
FIG. 11 is a perspective view illustrating a main body of a case according to an embodiment of the disclosure.

FIG. 11 is a perspective view illustrating a main body of a case according to an embodiment of the disclosure.

Figure 12:
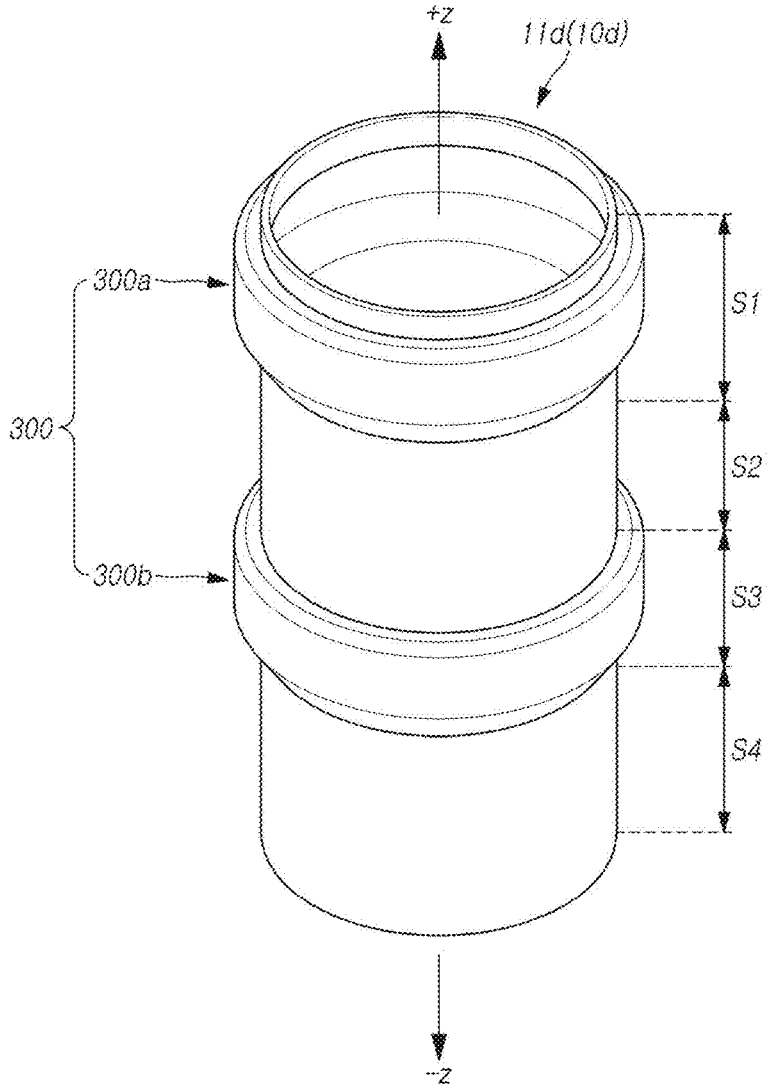
FIG. 12 is a perspective view illustrating a main body of a case according to an embodiment of the disclosure.

FIG. 12 is a perspective view illustrating a main body of a case according to an embodiment of the disclosure.

Referring to FIGS. 10 to 12, a case 10*c* and 10*d* according to an embodiment may include an oil trap portion 300 for separating the refrigerant and the oil or collecting the separated oil when the compressor (e.g., the compressor 1 of FIG. 1) is operated.

The configuration of the oil trap portion 300 of FIGS. 10 to 12 may be identical in whole or part to the configuration of the oil trap portions 100 and 200 of FIGS. 1 to 9. The embodiments of FIGS. 10 to 12 may be selectively combined with the embodiments of FIGS. 1 to 9 and the embodiment of FIG. 13.

According to an embodiment, the oil trap portion 300 may be convex to the outside of the case 10*c* and 10*d* and may be configured to have a hollow embossed (or embossing) structure. In an embodiment, the outer surface of the oil trap portion 300 may protrude from the outer surface 111 of the main body 11*c* and 11*d* of the case 10*c* and 10*d*. In an embodiment, the inner surface of the oil trap portion 300 may be recessed from the inner surface 112 of the main body 11*c* and 11*d* of the case 10*c* and 10*d*. The outer surface and the inner surface of the oil trap portion 300 may form a step with the outer surface 111 and the inner surface 112 of the main body 11*c* and 11*d*. In this case, a space 304 in which oil is accommodated may be formed inside the oil trap portion 300 when the compressor 1 is operated.

According to an embodiment, the oil trap portion 300 may be disposed in at least one of the plurality of areas S1, S2, S3, and S4. For example, the oil trap portion 300 may be disposed in the upper cavity area S1 in which the refrigerant and/or the oil flow is formed when the compressor 1 is operated among the plurality of areas S1, S2, S3, and S4.

According to an embodiment, the oil trap portion 300 may include a plurality of walls 301, 302, and 303 surrounding and defining the space 304 in which oil is accommodated. According to an embodiment, the plurality of walls 301, 302, and 303 may include a side wall 301 forming a side surface of the oil trap portion 300, an upper wall 302 forming an upper surface of the oil trap portion 300, and a lower wall 303 forming a lower surface of the oil trap portion 300.

According to an embodiment, the side wall 301 of the oil trap portion 300 may extend along the circumference of the main body 11*c*. The oil trap portion 300 may have an ring shape when viewed from above (e.g., in the +z-axis direction).

According to an embodiment, the upper wall 302 of the oil trap portion 300 may have a horizontal plane for preventing oil contained in the space 304 of the oil trap portion 300 from flowing to a discharge pipe (e.g., the discharge pipe 14 of FIG. 1). For example, the upper wall 302 of the oil trap portion 300 may be disposed perpendicular to the outer surface 111 and the inner surface 112 of the main body 11*c* and 11*d* of the case 10*c* and 10*d*.

According to an embodiment, the lower wall 303 of the oil trap portion 300 may have an inclined surface for guiding the oil accommodated in the space 304 of the oil trap portion 300 to the lower portion of the case 10*c* and 10*d*. For example, the lower wall 303 of the oil trap portion 300 may be disposed to be inclined with respect to the outer surface 111 and the inner surface 112 of the main body 11*c* and 11*d* of the case 10*c* and 10*d*.

According to an embodiment, a plurality of oil trap portions 300 may be provided. In an embodiment, the plurality of oil trap portions 300*a* and 300*b* may be disposed to be spaced apart from each other along the upper/lower direction (e.g., the ±z-axis direction) of the main body 11*d* of the case 10*d*. For example, as illustrated in FIG. 12, the plurality of oil trap portions 300*a* and 300*b* may include a first oil trap portion 300*a* disposed in the first area S1 and a second oil trap portion 300*b* spaced apart from the first oil trap portion 300*a* in the upper/lower direction and disposed in the third area S3.

Figure 13:
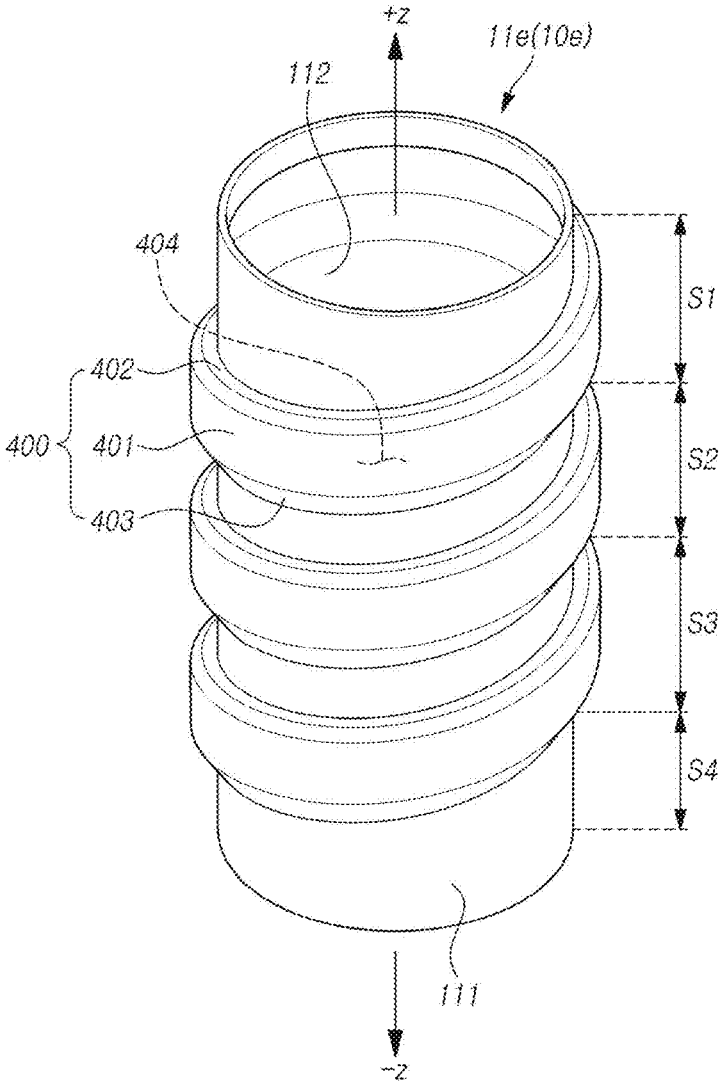
FIG. 13 is a perspective view illustrating a main body of a case according to an embodiment of the disclosure.

FIG. 13 is a perspective view illustrating a main body of a case according to an embodiment of the disclosure.

Referring to FIG. 13, a case 10*e* according to an embodiment may include an oil trap portion 400 for separating the refrigerant and the oil or collecting the separated oil when the compressor (e.g., the compressor 1 of FIG. 1) is operated.

The configuration of the oil trap portion 400 of FIG. 13 may be identical in whole or part to the configuration of the oil trap portions 100, 200, and 300 of FIGS. 1 to 12. The embodiment of FIG. 13 may be selectively combined with the embodiments of FIGS. 1 to 12.

According to an embodiment, the oil trap portion 400 may be convex to the outside of the case 10*e* and may be configured to have a hollow embossed (or embossing) structure. In an embodiment, the outer surface of the oil trap portion 400 may protrude from the outer surface 111 of the main body 11*e* of the case 10*e*. In an embodiment, the inner surface of the oil trap portion 400 may be recessed from the inner surface 112 of the main body 11*e* of the case 10*e*. The outer surface and the inner surface of the oil trap portion 400 may form a step with the outer surface 111 and the inner surface 112 of the main body 11*e*. In this case, a space 404 in which oil is accommodated may be formed inside the oil trap portion 400 when the compressor 1 is operated.

According to an embodiment, the oil trap portion 400 may be disposed to span at least one of the plurality of areas S1, S2, S3, and S4. For example, as illustrated in FIG. 13, the oil trap portion 400 may be disposed to span all of the plurality of areas S1, S2, S3, and S4. For example, the oil trap portion 400 may extend in the upper/lower direction (e.g., the ±z-axis direction) of the main body 11*d* to have an spiral shape. In this case, the extended length of the oil trap portion 400 may be limited to the upper surface of the oil stored in the lower portion of the case 10*d*.

According to an embodiment, the oil trap portion 400 may include a plurality of walls 401, 402, and 403 surrounding and defining the space 404 in which oil is accommodated. According to an embodiment, the plurality of walls 401, 402, and 403 may include a side wall 401 forming a side surface of the oil trap portion 400, an upper wall 402 forming an upper surface of the oil trap portion 400, and a lower wall 403 forming a lower surface of the oil trap portion 400.

According to an embodiment, the side wall 401 of the oil trap portion 400 may extend in the upper/lower direction (e.g., the +z-axis direction) while having a predetermined inclination along the circumference of the main body 11*e*.

According to an embodiment, the upper wall 402 of the oil trap portion 400 may have a horizontal plane for preventing oil contained in the space 404 of the oil trap portion 400 from flowing to a discharge pipe (e.g., the discharge pipe 14 of FIG. 1). For example, the upper wall 402 of the oil trap portion 400 may be disposed perpendicular to the outer surface 111 and the inner surface 112 of the main body 11*e* of the case 10*e*.

According to an embodiment, the lower wall 403 of the oil trap portion 400 may have an inclined surface for guiding the oil accommodated in the space 404 of the oil trap portion 100 to the lower portion of the case 10*e*. For example, the lower wall 403 of the oil trap portion 400 may be disposed to be inclined with respect to the outer surface 111 and the inner surface 112 of the main body 11*e* of the case 10*e*.

A compressor 1 according to an embodiment of the disclosure may include a case 10 storing an oil therein, a compression device 20 disposed inside the case 10 to compress a refrigerant introduced into the case 10, a driving device 30 disposed inside the case 10 to drive the compression device 20, and an oil trap portion 100, 200, 300, 400 for separating the refrigerant and the oil or collecting the separated oil when the compression device 20 is operated. The oil trap portion 100, 200, 300, 400 may protrude from an outer surface 111 of the case 10 and be recessed from an inner surface 112 of the case 10 to form a space 106, 206, 304, 404 for accommodating the oil. The oil trap portion 100, 200, 300, 400 may have at least a portion positioned in a cavity area S1, S3 of the case in which the compression device 20 and the driving device 30 are not disposed.

According to an embodiment, the oil trap portion 100, 200 may include a plurality of walls 101, 102, 103, 104, 105, 201, 202, 203, 204, 205 surrounding the space 106, 206 and defining the space 106, 206. The plurality of walls 101, 102, 103, 104, 105, 201, 202, 203, 204, 205 may include a front wall 101, 201, an upper wall 102, 202, a lower wall 103, 203, and a side wall 104, 105, 204, 205.

According to an embodiment, the front wall 101, 201 of the plurality of walls 101, 102, 103, 104, 105, 201, 202, 203, 204, 205, may have a circular or polygonal shape.

According to an embodiment, the upper wall 102, 202 of the plurality of walls 101, 102, 103, 104, 105, 201, 202, 203, 204, 205, may have a horizontal plane for blocking a flow of the oil accommodated in the space 106, 206 to an upper portion of the case 10.

According to an embodiment, the lower wall 103, 203 of the plurality of walls 101, 102, 103, 104, 105, 201, 202, 203, 204, 205, may have an inclined surface for guiding the oil accommodated in the space 106, 206 to a lower portion of the case 10.

According to an embodiment, an angle between an outer surface 111 of the case 10 and the side wall 104, 105, 204, 205 of the oil trap portions 100, 200 may be designed to range from 90 degrees to 120 degrees.

According to an embodiment, a plurality of the oil trap portions 100, 200 may be provided. The plurality of oil trap portions 100, 200 may be disposed to be spaced apart from each other along a circumferential direction of the case 10.

According to an embodiment, the oil trap portion 100, 200 may extend vertically along a longitudinal direction of the case 10.

According to an embodiment, the oil trap portion 400 may extend to be inclined along a longitudinal direction of the case to have an spiral shape.

According to an embodiment, the extended length of the oil trap portion 200, 400 may be limited to an upper surface of the oil stored in the case 10.

According to an embodiment, a plurality of the oil trap portions 100, 300 may be provided. The plurality of oil trap portions 100, 300 may be disposed to be spaced apart from each other in a longitudinal direction of the case 10.

According to an embodiment, the oil trap portion 300 extends along a circumferential direction of the case 10.

A home appliance for adjusting a temperature through heat exchange with an outside using a refrigerant, according to an embodiment of the disclosure, may include a compressor 1 for compressing the refrigerant, wherein the compressor 1 may include a case 10 storing oil therein, a compression device 20 disposed inside the case 10 to compress a refrigerant introduced into the case 10, a driving device 30 disposed inside the case 10 to drive the compression device 20, and an oil trap portion 100, 200, 300, 400 for separating the refrigerant and the oil or collecting the separated oil when the compression device 20 is operated. The oil trap portion 100, 200, 300, 400 may protrude from an outer surface 111 of the case 10 and be recessed from an inner surface 112 of the case 10 to form a space 106, 206, 304, 404 for accommodating the oil. The oil trap portion 100, 200, 300, 400 may have at least a portion positioned in a cavity area S1, S3 of the case in which the compression device 20 and the driving device 30 are not disposed.

According to an embodiment, the oil trap portion 100, 200 may include a plurality of walls 101, 102, 103, 104, 105, 201, 202, 203, 204, 205 surrounding the space 106, 206 and defining the space 106, 206. The plurality of walls 101, 102, 103, 104, 105, 201, 202, 203, 204, 205 includes a front wall 101, 201, an upper wall 102, 202, a lower wall 103, 203, and a side wall 104, 105, 204, 205.

According to an embodiment, the front wall 101, 201 of the plurality of walls 101, 102, 103, 104, 105, 201, 202, 203, 204, 205 may have a circular or polygonal shape.

According to an embodiment, the upper wall 102, 202 of the plurality of walls 101, 102, 103, 104, 105, 201, 202, 203, 204, 205, may have a horizontal plane for blocking a flow of the oil accommodated in the space 106, 206 to an upper portion of the case 10.

According to an embodiment, the lower wall 103, 203 of the plurality of walls 101, 102, 103, 104, 105, 201, 202, 203, 204, 205 may have an inclined surface for guiding the oil accommodated in the space 106, 206 to a lower portion of the case 10.

According to an embodiment, an angle between an outer surface 111 of the case 10 and the side wall 104, 105, 204, 205 of the oil trap portions 100, 200 may be designed to range from 90 degrees to 120 degrees.

According to an embodiment, the oil trap portion 400 may extend to be inclined along a longitudinal direction of the case to have an spiral shape.

According to an embodiment, the oil trap portion 300 may extend along a circumferential direction of the case 10.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A compressor, comprising:

a case storing an oil therein;

a compression device disposed inside the case to compress a refrigerant introduced into the case;

a driving device disposed inside the case to drive the compression device; and an oil trap portion for separating the refrigerant and the oil or collecting the separated oil when the compression device is operated, the oil trap portion protruding from an outer surface of the case and being recessed from an inner surface of the case to form a space for accommodating the oil, the oil trap portion having a front wall and an unobstructed opening from the space to an inside of the inner surface of the case, the unobstructed opening having an area equal to or greater than an area of the front wall, wherein the oil trap portion has at least a portion positioned in a cavity area of the case in which the compression device and the driving device are not disposed.

2. The compressor of claim 1, wherein the oil trap portion includes a plurality of walls surrounding the space and defining the space, and wherein the plurality of walls include the front wall, an upper wall, a lower wall, and a side wall.

3. The compressor of claim 2, wherein the front wall of the plurality of walls has a circular or polygonal shape.

4. The compressor of claim 2, wherein the upper wall of the plurality of walls has a horizontal plane for blocking a flow of the oil accommodated in the space to an upper portion of the case.

5. The compressor of claim 2, wherein the lower wall of the plurality of walls has an inclined surface for guiding the oil accommodated in the space to a lower portion of the case.

6. The compressor of claim 2, wherein an angle between an outer surface of the case and the side wall of the oil trap portion is designed to range from 90 degrees to 120 degrees.

7. The compressor of claim 1, wherein a plurality of the oil trap portions are provided, and wherein the plurality of the oil trap portions are disposed to be spaced apart from each other along a circumferential direction of the case.

8. The compressor of claim 1, wherein the oil trap portion extends vertically along a longitudinal direction of the case.

9. The compressor of claim 1, wherein the oil trap portion extends to be inclined along a longitudinal direction of the case to have a spiral shape.

10. The compressor of claim 9, wherein an extended length of the oil trap portion is limited to an upper surface of the oil stored in the case.

11. The compressor of claim 1, wherein a plurality of the oil trap portions are provided, and wherein the plurality of the oil trap portions are disposed to be spaced apart from each other in a longitudinal direction of the case.

12. The compressor of claim 1, wherein the oil trap portion extends along a circumferential direction of the case.

13. The compressor of claim 1, wherein the compressor comprises a rotary compressor.

14. The compressor of claim 1, wherein the oil trap portion includes at least two separate oil trap portions a first oil trap portion disposed in the cavity area of the case in which the compression device and the driving device are not disposed, and a second oil trap portion disposed in second separate cavity area of the case in which the compression device and the driving device are also not disposed.

15. A home appliance for adjusting a temperature through heat exchange with an outside using a refrigerant, the home appliance comprising:

a compressor for compressing the refrigerant, wherein the compressor comprises:

a case storing an oil therein, a compression device disposed inside the case to compress a refrigerant introduced into the case, a driving device disposed inside the case to drive the compression device, and an oil trap portion for separating the refrigerant and the oil or collecting the separated oil when the compression device is operated, the oil trap portion protruding from an outer surface of the case and being recessed from an inner surface of the case to form a space for accommodating the oil, the oil trap portion having a front wall and an unobstructed opening from the space to an inside of the inner surface of the case, the unobstructed opening having an area equal to or greater than an area of the front wall, wherein the oil trap portion has at least a portion positioned in a cavity area of the case in which the compression device and the driving device are not disposed.

16. The home appliance of claim 15, wherein the oil trap portion includes a plurality of walls surrounding the space and defining the space, and wherein the plurality of walls include the front wall, an upper wall, a lower wall, and a side wall.

17. The home appliance of claim 16, wherein the front wall of the plurality of walls has a circular or polygonal shape.

18. The home appliance of claim 16, wherein the upper wall of the plurality of walls has a horizontal plane for blocking a flow of the oil accommodated in the space to an upper portion of the case.

19. The home appliance of claim 16, wherein the lower wall of the plurality of walls has an inclined surface for guiding the oil accommodated in the space to a lower portion of the case.

20. The home appliance of claim 16, wherein an angle between an outer surface of the case and the side wall of the oil trap portions is designed to range from 90 degrees to 120 degrees.

21. The home appliance of claim 15, wherein the oil trap portion extends to be inclined along a longitudinal direction of the case to have a spiral shape.

22. The home appliance of claim 15, wherein the oil trap portion extends along a circumferential direction of the case.

* * * * *